US008292108B2

(12) United States Patent
Rosentreler

(10) Patent No.: US 8,292,108 B2
(45) Date of Patent: Oct. 23, 2012

(54) PACKAGE ADAPTED TO RECEIVE AN OPENING DEVICE

(75) Inventor: Antje Rosentreler, Wuppertal (DE)

(73) Assignee: Stora Enso OYJ, Helsinki (FI)

( * ) Notice: Subject to any disclaimer, the term of this patent is extended or adjusted under 35 U.S.C. 154(b) by 1056 days.

(21) Appl. No.: 12/096,141

(22) PCT Filed: Dec. 21, 2006

(86) PCT No.: PCT/EP2006/070085

§ 371 (c)(1),
(2), (4) Date: Jul. 18, 2008

(87) PCT Pub. No.: WO2007/071763

PCT Pub. Date: Jun. 28, 2007

(65) Prior Publication Data

US 2008/0272121 A1 Nov. 6, 2008

(30) Foreign Application Priority Data

Dec. 21, 2005 (EP) ..... 05445096

(51) Int. Cl.
*B65D 25/00* (2006.01)

(52) U.S. Cl. ..... 220/62; 229/249; 229/125.15

(58) Field of Classification Search ..... 220/62, 220/269; 229/213, 214, 915.1, 249, 248, 229/124, 125.01, 125.42, 125.04, 125.15
See application file for complete search history.

(56) References Cited

U.S. PATENT DOCUMENTS

| | | | | |
|---|---|---|---|---|
| 4,078,715 | A * | 3/1978 | Larsson et al. | 229/216 |
| 4,740,163 | A | 4/1988 | Kuchenbecker | |
| 4,813,546 | A * | 3/1989 | Gordon et al. | 229/214 |
| 5,014,854 | A * | 5/1991 | Anderson et al. | 229/214 |
| 5,156,330 | A * | 10/1992 | Rosen | 229/214 |
| 5,716,473 | A | 2/1998 | Gordon et al. | |
| 6,253,994 | B1 | 7/2001 | Mogard | |
| 6,402,019 | B1 * | 6/2002 | Casale | 229/123.2 |
| 2003/0146271 | A1 * | 8/2003 | Furini et al. | 229/125.15 |
| 2004/0011688 | A1 * | 1/2004 | Ishikawa | 206/431 |

FOREIGN PATENT DOCUMENTS

| | | |
|---|---|---|
| EP | 1 172 301 | 1/2002 |
| EP | 1 591 367 | 11/2005 |
| FR | 1262203 | 5/1961 |

* cited by examiner

*Primary Examiner* — Jacob K Ackun
*Assistant Examiner* — Jenine Pagan
(74) *Attorney, Agent, or Firm* — Greer, Burns & Crain, Ltd

(57) ABSTRACT

The invention relates to a package and a blank comprising a front panel (10), a back panel (12) and two side panels (14, 16) forming a tubular container body extending in a longitudinal direction (L) from a bottom to a top, a first top panel (30) formed by an extension of the front panel (10) in the longitudinal direction (L) and being folded to essentially form the top of the package, a first set of two flaps (40, 60) each formed by an extension of respective side panel (14, 16) in the longitudinal direction (L), and a second set of two flaps (45, 65) extending in mutual opposing transverse directions (T1, T2) which are transverse to the longitudinal direction (L), each flap (45, 65) being formed by an extension of the first top panel (30) on a respective side edge of the first top panel (30).

2 Claims, 5 Drawing Sheets

PACKAGE ADAPTED TO RECEIVE AN OPENING DEVICE

CROSS-REFERENCE

This application is a Section 371 national stage of International Application No. PCT/EP2006/070085 filed Dec. 21, 2006, which claims priority from European Application No. 05445096.0 filed Dec. 21, 2005.

FIELD OF INVENTION

The invention relates to a package having an extended top panel. It is contemplated to use the package for wet or dry pourable food products, such as juice, milk, wine, tomato sauce, cornflakes or the like, and the basic design concept of the package is therefore adapted to make this contemplated use possible. The package may be used for other kinds of goods.

TECHNICAL BACKGROUND

EP 1 172 301 discloses a sealed package for pourable food products. The package is made from a sheet packaging material and has a top wall crossed by a transverse sealing band forming a flat projecting tab folded coplanar with and onto the top wall along a fold line. An opening device is fitted to a portion of the top wall. The tab has a strip-like auxiliary portion interposed between the sealing band and the fold line, so that the area of the portion of the top wall available for the opening device is increased by the width of the auxiliary portion. It may however be noted that on the inside of the package the fold line will interfere with the available free pouring area of the opening device. The auxiliary area will only give an enlarged fastening area on the outside of the package.

Thus, there is no satisfactory solution to form a package adapted to receive a large opening device which may have a large available pouring area.

SUMMARY OF THE INVENTION

It is an object of the invention to provide a package adapted to receive a large opening device offering a large available pouring area.

This object has been achieved by a package comprising a front panel, a back panel and two side panels forming a tubular container body extending in a longitudinal direction from a bottom to a top, characterised in that the package further comprises a first top panel formed by an extension of the front panel in the longitudinal direction and being folded to essentially form the top of the package, a first set of two flaps, each formed by an extension of respective side panel in the longitudinal direction and being folded to be planar with respective side panel, and a second set of two flaps extending in mutual opposing transverse directions which are transverse to the longitudinal direction, each flap being formed by an extension of the top panel on a respective side edge of the first top panel and being folded to be planar with respective side panel, wherein each of the two flaps of the first set being associated with a respective flap of the second set of flaps, and wherein respective inside surface of a flap of the first set abuts an inside surface of the respective associated flap of the second set.

With this combination of flaps and panels it is possible to form a package where all of the top panel may be used as available area for receiving an opening device. Since the flaps of the first set of flaps abut the insides of the second set of flaps, the flaps will extend outwardly of the package. The lugs formed by the mutually abutting flaps are folded downwardly to be planar with and abut the outer side of the side panels and will thereby not interfere with the available surface for the opening device. Since there is no flaps or panels extending into the package there is neither any flap or panel interfering with the free pouring area as is the case in the prior art.

The combination of flaps and panels also makes it possible to form tight package adapted for wet or dry pourable food products such as such as juice, milk, wine, tomato sauce, cornflakes or the like. The panels and flaps are extensions of each other and they are adapted to abut each other in order to be sealed to each other.

Furthermore, since the second set of flaps extend in the transverse directions from the first top panel the first top panel may have an extension essentially covering the complete top of the package. The flaps of the second set of flaps will still be able to secure the first top panel to the side panels when the first top panel is folded to form the top of the package.

Preferred embodiments follow from the dependent claims.

The package may further comprise a second top panel formed by an extension of the back panel in the longitudinal direction and being folded to partly form the top of the package together with the first top panel. This way it is easy to provide a planar top and still have a large available surface for the provision of an opening device. The second top panel preferably only extend along the top a distance being sufficient to provide a secure and tight seal to the first panel, whereas the first top panel form the major part of the top of the package.

The first and second top panels may each comprise a sealing area extending from respective top panel in the longitudinal direction, and along and a distance past respective top panel in the transverse directions. By providing a sealing area in this manner which extends along the top panels and which has an extension slightly outside the top panels in the transverse direction it is possible to form the seal by abutting the insides of the sealing areas. This way it is e.g. possible to use a laminated packaging material with a heat sealable polymer layer on the inside. By extending the sealing area it will be possible to have it connected to the second set of panels and thereby have an automatic guidance of the sealing areas as an extension of the first top panel on the finished package. The sealing area on the second top panel will thereby be folded onto the second top panel which minimises the surface area that is lost by the introduction of the second top panel.

The second top panel may have an extension in the longitudinal direction being equal to the extension in the longitudinal direction of the sealing area of the second top panel. With this design the sealing fin formed by the abutting sealing areas will, when folded backwardly to abut the second top panel, have its upper edge essentially in flush with the back panel. This way a maximum surface area for receiving an opening device may be formed of the first top panel and still the sealing fin will not extend past the footprint of the package. Moreover, the package will have an aesthetically attractive appearance with the no distinct lines on the top surface of the package. It is preferred that the upper edge of the sealing fin is slightly within perimeter of the top surface in order to avoid that the sealing fin by mistake get caught e.g. by a neighbouring package.

Respective side panel may have a width extending in parallel with the transverse directions and wherein respective flap of the first set of flaps may be formed as a triangle or truncated triangle having its base extending along said width, and preferably along the whole width. By forming the flaps in this manner they will be able to make the seal at the extension of the side panels tight whereas they still make it possible to form the flaps of the second set as desired, since they will leave at least the same amount of available geometric space.

The first top panel may have a length along the longitudinal direction before folded as a top panel and wherein respective flap of the second set of flaps may be formed as a triangle or truncated triangle having its base extending along said length, and preferably along the whole length. Similarly as for the flaps of the first set of flaps this manner of forming the flaps will make the flaps able to make the seal at the extension of the top panel tight whereas they still make it possible to form the flaps of the first set as desired, since they will leave at least the same amount of available geometric space.

The package further comprises an opening device located on the first top panel. As mentioned above the top panels is formed in a manner that almost all of the surface area of the top of the package is available for the opening device. Further, there are no flaps or panel extending into the package, which flaps or panels otherwise would potentially interfere with the free pouring area of the opening device.

It is an further object of the invention to provide a blank adapted to be folded into a package which is adapted to receive a large opening device offering a large available pouring area.

This object has been achieved by a blank comprising a front panel, a back panel and two side panels adapted to form a tubular container body and thereby extend in a longitudinal direction from a bottom to a top, characterised in that the blank further comprises a first top panel formed by an extension of the front panel in the longitudinal direction and being foldable to essentially form a top of a package, a first set of two flaps, wherein a) each flap being formed by an extension of the first top panel on a respective side edge of the first top panel and being foldable in respect of the first top panel, or b) a first flap of the second set is formed by an extension of the first top panel on a side of the first top panel and a second flap of the second set is formed by an extension on a side of a complementary first top panel adapted to coincide with the first top panel as the blank is formed into a package, wherein each of the two flaps of the first set being associated with a respective flap of the second set of flaps, and wherein respective inside surface of a flap of the first set is adapted to abut an inside surface of respective associated flap of the second set.

With this combination of flaps and panels it is possible to form a package where all of the top panel may be used as available area for receiving an opening device. Since the flaps of the first set of flaps are adapted to abut the insides of the second set of flaps, the flaps will extend outwardly of the finished package. The lugs formed by the mutually abutting flaps are foldable downwardly to be planar with and abut the outer side of the side panels and will thereby not interfere with the available surface for the opening device. Since there will be no flaps or panels extending into the finished package there is neither any flap or panel interfering with the free pouring area as is the case in the prior art.

The combination of flaps and panels also makes it possible to form tight package adapted for wet or dry pourable food products such as such as juice, milk, wine, tomato sauce, cornflakes or the like. The panels and flaps are extensions of each other and they are adapted to abut each other in order to be sealed to each other.

Furthermore, since the second set of flaps extend in the transverse directions from the first top panel the first top panel may have an extension essentially covering the complete top of the package. The flaps of the second set of flaps will still be able to secure the first top panel to the side panels when the first top panel is folded to form the top of the package.

The alternative in the claim relating to the blank is called for since the invention may be introduced in different kinds of blanks being longitudinally cut at different transverse locations.

If the longitudinal cut of the blank e.g. is located at the centre of the back panel, the flaps of the second set will be physical extensions of the top panel already as a blank.

If the longitudinal cut of the blank e.g. is located in a longitudinal corner at the front of the package, it will be a waste of material and it will be difficult to form the package if the flaps extend in both transverse directions from the top panel. In this case the side panel adapted to connect with the cut side of the front panel will have a small longitudinal sealing flap. This small longitudinal sealing flap will extend in the longitudinal direction and form a complementary top panel. This complementary top panel will carry the second flap of the flaps in the second set. Thus one of the flaps in the second set is formed as a true, physical extension of the top panel whereas the other flap is formed as an imaginary, geometrical extension of the top panel carried by a complementary top panel which will coincide with the first top panel when the blank is formed into a package. In this position the second flap will also become physical extension of the top panel.

Preferred embodiments follow from the dependent claims. The respective advantages achieved by respective feature of the dependent claims have been discussed in detail in respect of the corresponding features of the dependent claims related to the finished package. The same discussion apply also for the dependent claims related to the blank.

The blank may further comprise a second top panel formed by an extension of the back panel in the longitudinal direction and being adapted to be folded to partly form the top of the package together with the first top panel.

The first and second top panels may each comprise a sealing area extending from respective top panel in the longitudinal direction, and along and a distance past respective top panel in the respective transverse directions.

The second top panel may have an extension in the longitudinal direction being equal to the extension in the longitudinal direction of the sealing area of the second top panel.

Respective side panel may have a width extending in parallel with the transverse directions and wherein respective flap of the first set of flaps may be formed as a triangle or truncated triangle having its base extending along said width, and preferably along the whole width.

The first top panel may have a length along the longitudinal direction and wherein respective flap of the second set of flaps may be formed as a triangle or truncated triangle having its base extending along said length, and preferably along the whole length.

BRIEF DESCRIPTION OF THE DRAWINGS

The invention will hereinafter be described by way of examples of presently preferred embodiments with reference to the appended schematic drawings.

DETAILED DESCRIPTION OF PREFERRED EMBODIMENTS

The detailed description will refer to the blank or to the package dependent upon which term will give the best understanding. The blank discussed is an intermediate product for the forming of the package.

Figure 1:
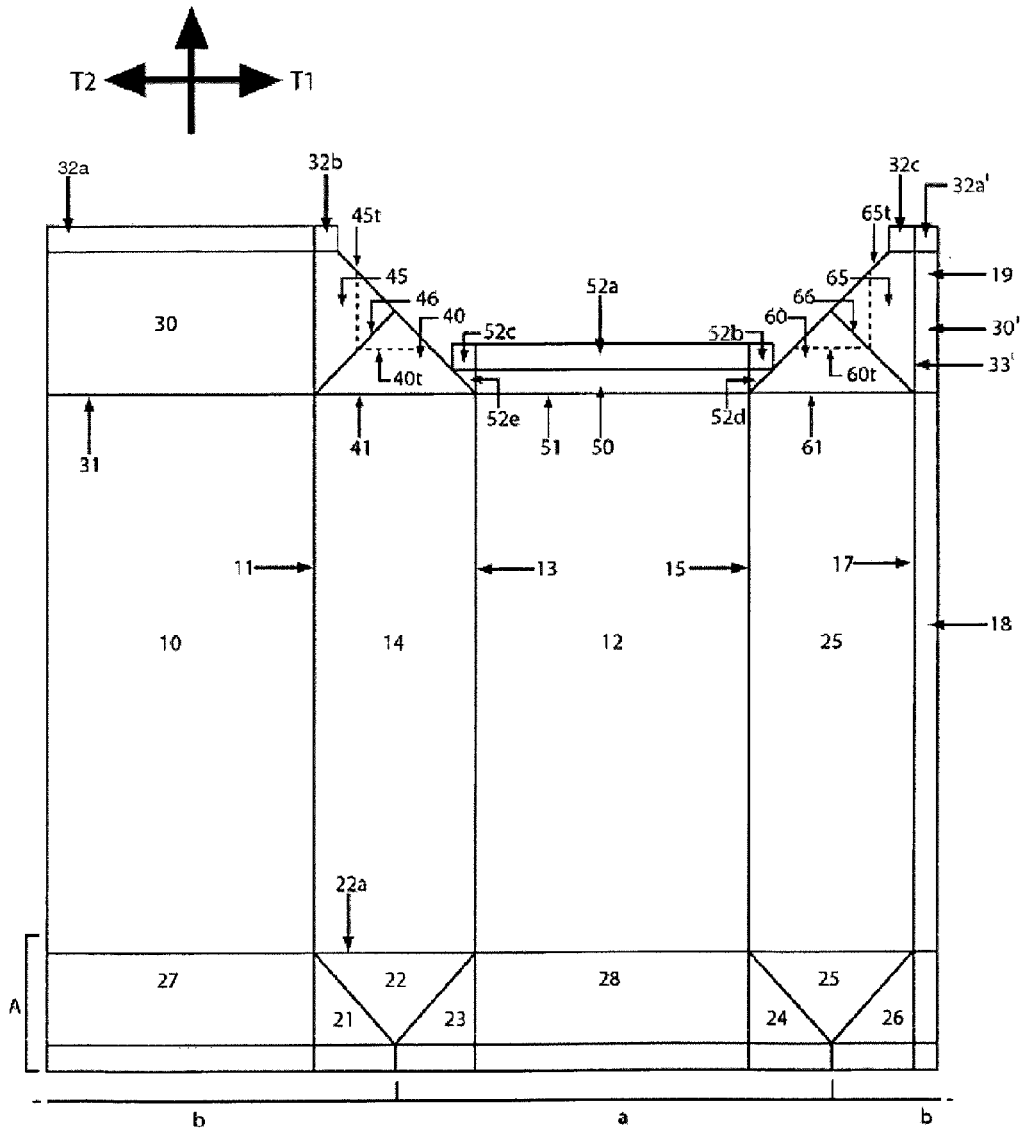
FIG. 1 is a blank in accordance with the invention showing the panels and flaps adapted to be folded and sealed to form a package in accordance with the invention.

With reference to FIG. 1, the blank comprises a front panel 10, a back panel 12 and two side panels 14, 16. The blank further comprises a longitudinal sealing flap 18 extending along one of the side panels 16. The front panel 10 and the first side panel 14 are joined by a crease line 11, the first side panel 14 and the back panel 12 are joined by a crease line 13, the back panel 12 and the second side panel 16 are joined by a crease line 15, and the second side panel 16 and the longitudinal sealing flap 18 are joined by a crease line 18. The front panel 10, the back panel 12 and the side panels 14, 16 are adapted to be mutually folded about the crease lines 11, 13, and 15 to form a tubular container body. The sealing flap 18 is foldable about the crease line 17 and is sealable to the front panel 10. The outside of the sealing flap 18 is sealed to the inside of the front panel 10.

At the bottom area A, the blank is provided with a continuous band of panels defined by a number of crease lines. The sealing areas a and b are adapted to abut each other, inside to inside and thereby form a so-called sealing fin. The triangular areas 21, 22 and 23 formed in the area forming and extension of the first side panel are adapted to be folded such that the smaller triangular areas 21 and 23 are folded back onto the larger triangular area 22. Thereby a triangular lug of the closed container is formed. This lug may be folded about the crease line 22*a* between the side panel 14 and the triangular area 22 to abut and to be sealed to the bottom of the package. Similarly the triangular areas 24, 25, 26 formed in the area forming an extension of the second side panel 16 will be folded to form a lug which in turn is folded and sealed to the bottom of the package. The bottom panels 27 and 28 will be folded towards each other such that the sealing areas a and b abut each other. The two bottom panels 27 and 28 will each occupy half of the bottom of the package. This bottom forming method will not be discussed in more detail since it is well-known in the art to form a bottom of a package using this continuous band of panels defined by a number of crease lines.

The blank further comprises a first top panel 40 formed by an extension of the front panel 10 in a longitudinal direction L. The first top panel 40 is foldable in relation to the front panel 10 about a crease line 31 between the front panel 10 and the first top panel 30.

A second top panel 50 is formed by an extension of the back panel 12 in the longitudinal direction L. The second top panel 50 is foldable in relation to the back panel 12 about a crease line 51 between the back panel 12 and the second top panel 50.

The blank further comprises a first set of two flaps 40, 60, each formed by an extension of the respective side panel 14, 16. The flaps 40, 60 are foldable about a respective crease line 41, 61 between the flaps 40, 60 and respective side panel 14, 16.

Figure 2:
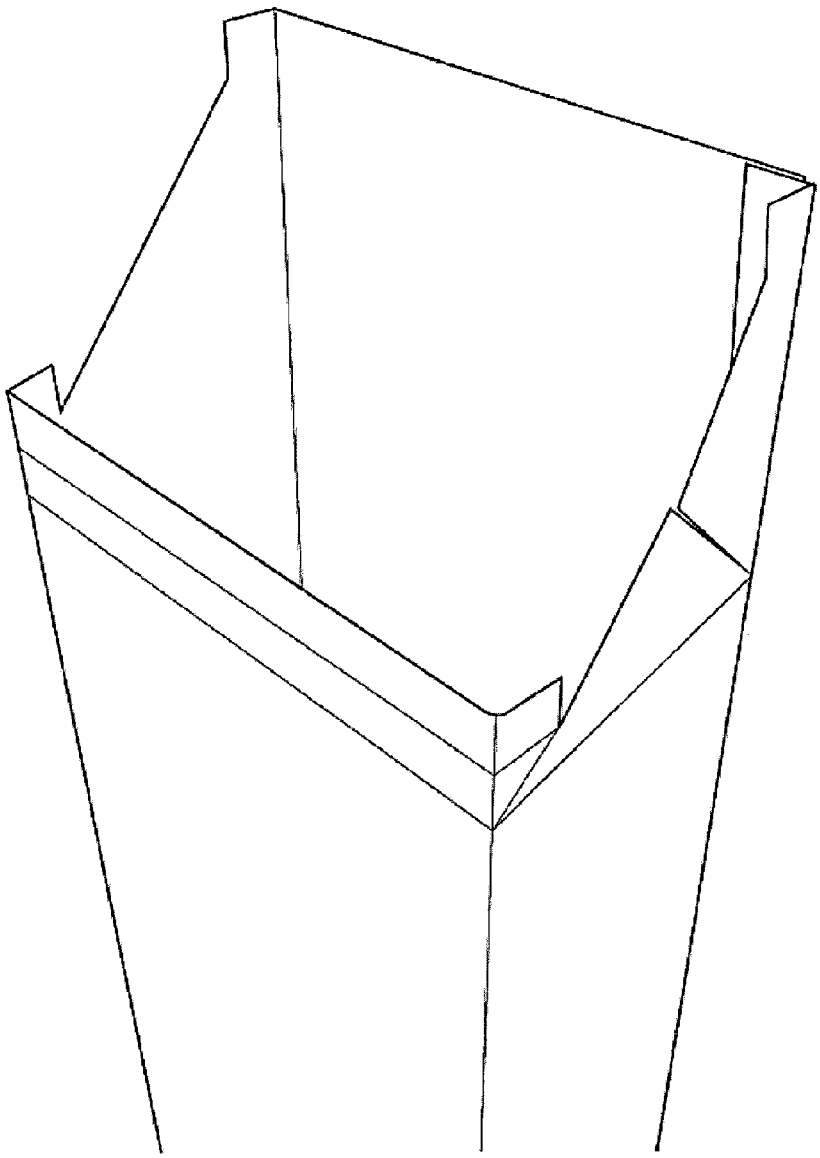
FIG. 2 shows in perspective from above the blank or package in a state where the blank has been folded to form a tube with an open top end.

The blank further comprises a second set of two flaps 45, 65, each formed by an extension of the top panel 30. It may be noted that one of the flaps 45 is formed as a true, physical extension of the top panel 30 whereas the other flap 65 is formed as an imaginary, geometrical extension of the top panel 30. The sealing area 19 being an extension of the sealing flap 18 in the longitudinal direction L will form part 30' of the first top panel 30 when the blank is folded to form an tubular container body with an open end as shown in FIG. 2. In this position the second flap 65 will also become physical extension of the top panel 30. If the longitudinal cut of the blank would have been located at the centre of the back panel 12, the flaps 45, 65 would have been physical extensions of the top panel 30 already as a blank and the imaginary extension 30' of the top panel 30 would not be present in the blank. The flaps 45, 65 of the second set of flaps are foldable about crease lines 33, 33' in common with respective portion of the first top panel 30, 30'.

Each of the flaps 40, 60 is associated with a respective flap 45, 65 of the second set of flaps. The flaps 40, 45 located in the area forming an extension of the first side panel 14 are associated with each other and the flaps 60, 65 located in the area forming an extension of the second side panel 16 are associated with each other. The flaps 40, 60 of the first set of flaps are separated from the respective associated flap 45, 65 of the second set of flaps by a cut line 46, 66.

Figure 3:
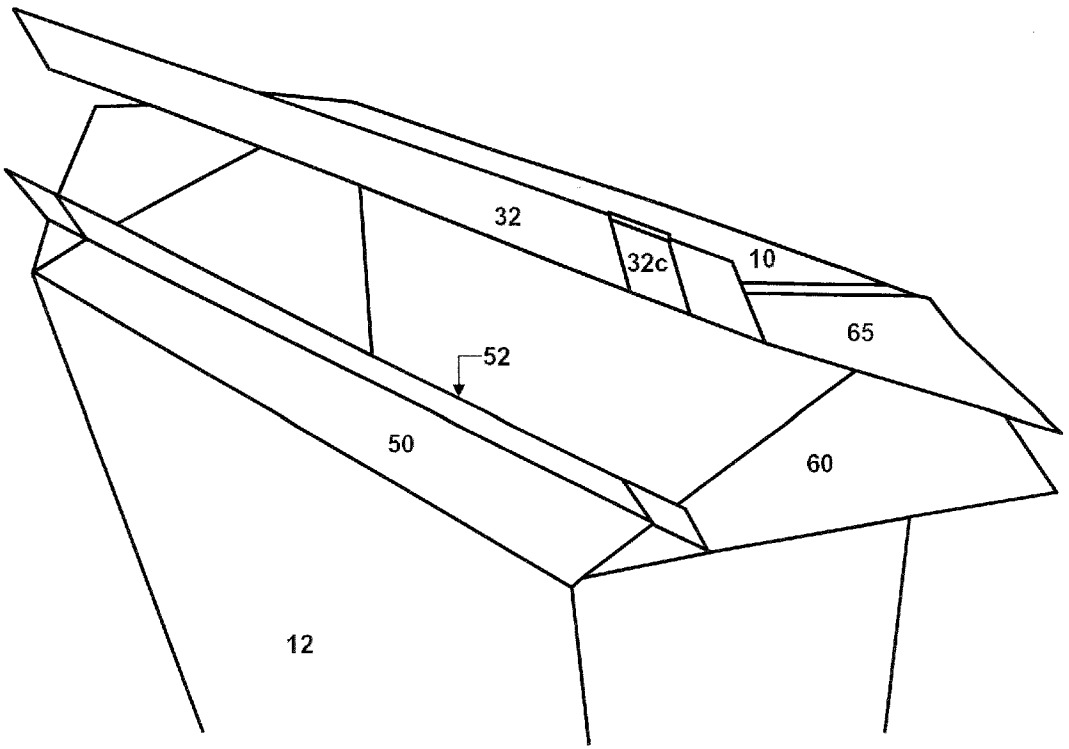
FIG. 3 shows in perspective from above the blank or package in a state where the top panels and associated flaps has begun to be folded.

When formed as a package, the associated flaps are adapted to abut and to be sealed or glued to each other inside to inside (see FIG. 3). In order to achieve tight corners The first and second top panels each comprises a sealing area 32, 52 extending from respective top panel 30, 30', 50 in the longitudinal direction L. The sealing areas 32, 52 extend past the respective top panel 30, 30', 50 in the respective transverse directions T1, T2 and form appended sealing areas 32*b*, 32*c*, 52*b*, 52*c* extending in the transverse directions T1, T2 from the major sealing areas 32*a*, 32*b* extending from the respective top panel 30, 50 and having the same width in the transverse direction as the respective top panel 30, 50.

As mentioned above the associated flaps 40, 45; 60, 65 of the first and second sets of flaps are separated by a cut line 46; 66. The thus formed flaps 40, 45, 60, 65 are triangular in shape. The flaps 40, 60 of the first set of flaps are formed as isosceles triangles having their respective base extending along all of the top edge (in the transverse direction) of the respective side panel 14, 16. The flaps 45, 65 of the second set of flaps are formed as isosceles triangles having their respective base extending along all of the height of the top panel 30, 30' in the longitudinal direction L. When the edges of two associated flaps 40, 45; 60, 65 are aligned as they were not cut the two triangles will form a triangle where the basis of the respective flaps will form the smaller sides of a right-angled triangle. Thus the associated flaps are formed of an right-angled isosceles triangle being divided into two equal halves by a cut line 46, 66 along the height of the large right-angled isosceles triangle.

As shown in FIG. 2, the front panel 10, the back panel 12, and the side panels 14, 16 forms a tubular container body. The appended sealing areas 32*b*, 32*c*, 52*b*, 52*c* will be guided to the desired position, since they are connected to the adjacent panel or flap as viewed in the longitudinal direction L. The sealing areas 32*b*, 32*c* are connected to the flaps 45, 65 of the second set of flaps. It may desired to have the flaps 45, 65 following the perimeter (as in FIG. 2) of the container or it may be desired to have them being essentially in the same plane as the first top panel 30. In any case the sealing areas 32*b*, 32*c* will be in the same plane as the flaps 45, 65. The sealing areas 52*b*, 52*c* will be guided by the small triangular panels 52*d*, 52*e* connected to the sealing areas 52*b*, 52*c*, to the side panels 14, 16 and to the flaps 40, 60 of the first set of flaps. Thereby the flaps 40, 60 and the sealing areas 52*b*, 52*c* of the second top panel 50 will follow the perimeter of the container body.

The presence of the triangular panels 52*d*, 52*e* in the corner between the three neighbouring panels or flaps; the appended sealing areas 52*b*, 52*c* of the second top panel 50, the second top panel 50, and the flaps 40, 60 of the first set of flaps are beneficial if it is desired to have a liquid tight package. The triangular panels 52*d*, 52*e* will provide a continuous material in the top corners at the back of the package. Similarly the connection between the appended sealing areas 32*b*, 32*c* and the flaps 45, 65 of the second set of flaps will provide a continuous material following the sealing fin 32, 52 out a distance from the container body.

Moreover, in order to provide tight corners where the front panel 10, respective side panel 14, 16 and the first top panel 30 form the two front upper corners of the formed package, the cut lines 46 and 66 are not cut all the way down to the corner of the front panel 10. The cut lines 46, 66 are transformed into crease lines at a distance from the corner of the front panel 10. The lengths of the not cut but creased portions of respective the cut line 46, 66 correspond to the lengths of the appended sealing areas 32*b*, 32*c*; 52*b*, 52*c*.

It should also be noted that except the cut, outer portions of the cut lines 46 and 66 all the lines inside the contour of the blank in FIG. 1 are crease lines which facilitate a correct folding of the blank into the package. The crease lines may be formed using any suitable creasing method.

With reference to FIG. 3, it may be noted that the sealing area 52 of the second top panel 50 is refolded back on to the top panel 50; outside to outside, whereas the sealing area 32 of the first top panel 30 extends in essentially the same plane as the first top panel 30. The sealing areas 32, 52 will be sealed to each other; inside to inside.

Figure 4:
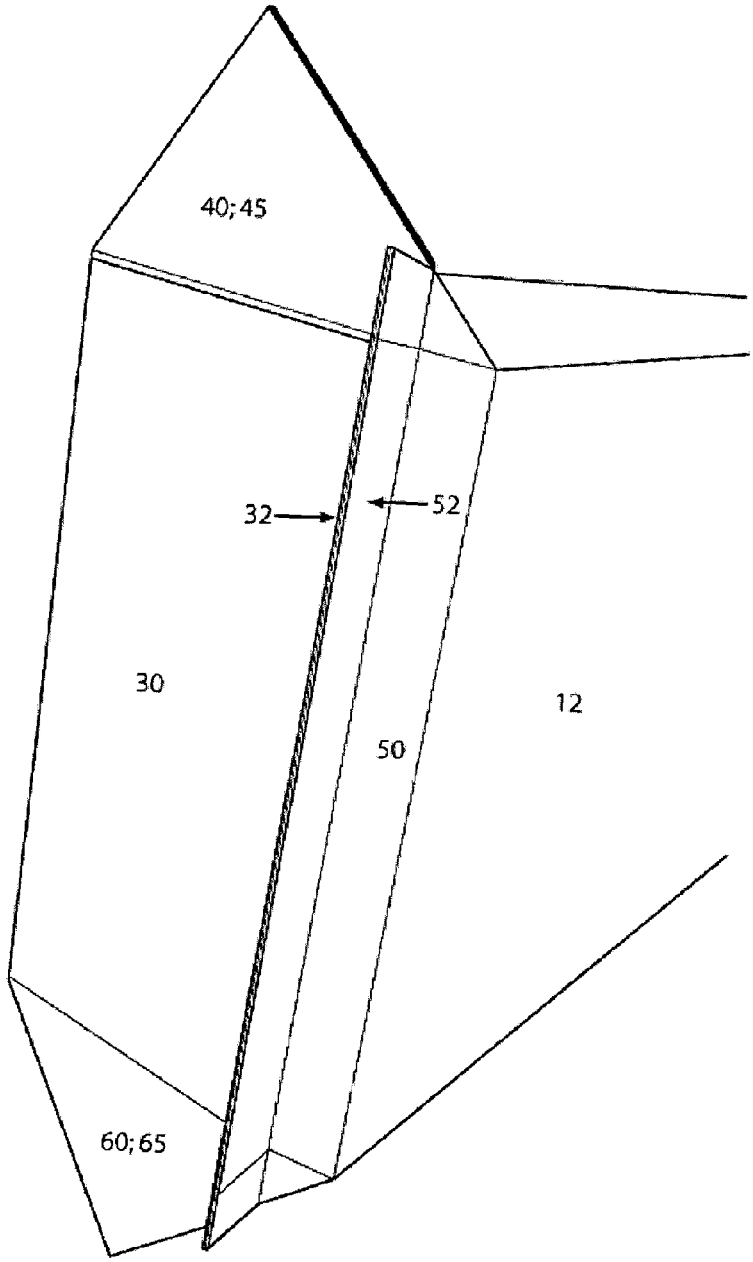
FIG. 4 shows in perspective from above the blank or package in state where the flaps and sealing areas are sealed but the package has not yet received its final shape.

The flaps 45, 65 of the second set of flaps will initially be folded outwardly about the crease lines 33, 33' and the flaps 40, 60 of the first set of flaps will initially extend in essentially the same plane as the first top panel 30. The flaps 40, 45; 60, 65 will be sealed to each other; inside to inside. When the sealing areas 42, 52 and the flaps 40, 45; 60, 65 are sealed to each the package will have reached the state as shown in FIG. 4.

Finally, the package is formed by folding the flaps 40, 45; 60, 65 down along the side panels 14, 16, respectively. With this folding of the flaps the sealing fin formed by the sealing areas 32, 52 will be folded and held down along the second top panel 50.

The package is be provided with an opening device 70 located on the first top panel 30. There are a number of occasions during the forming of the package when the opening device 70 may be provided to the package. It is e.g. suitable to provide the blank with a through-going hole in the first top panel 30 and to add the opening device to the package when it is in the state as shown in FIG. 2 since it at this point is easy to get access to both sides (inside and outside) of the first top panel 30. It may be noted that since the first top panel 30 has an extension in the longitudinal direction L being larger than the corresponding extension of the second top panel 50, there is free access to the inside of the first top panel 30 also for tools requiring space larger than the space available within the perimeter of the tubular container body.

Figure 5:
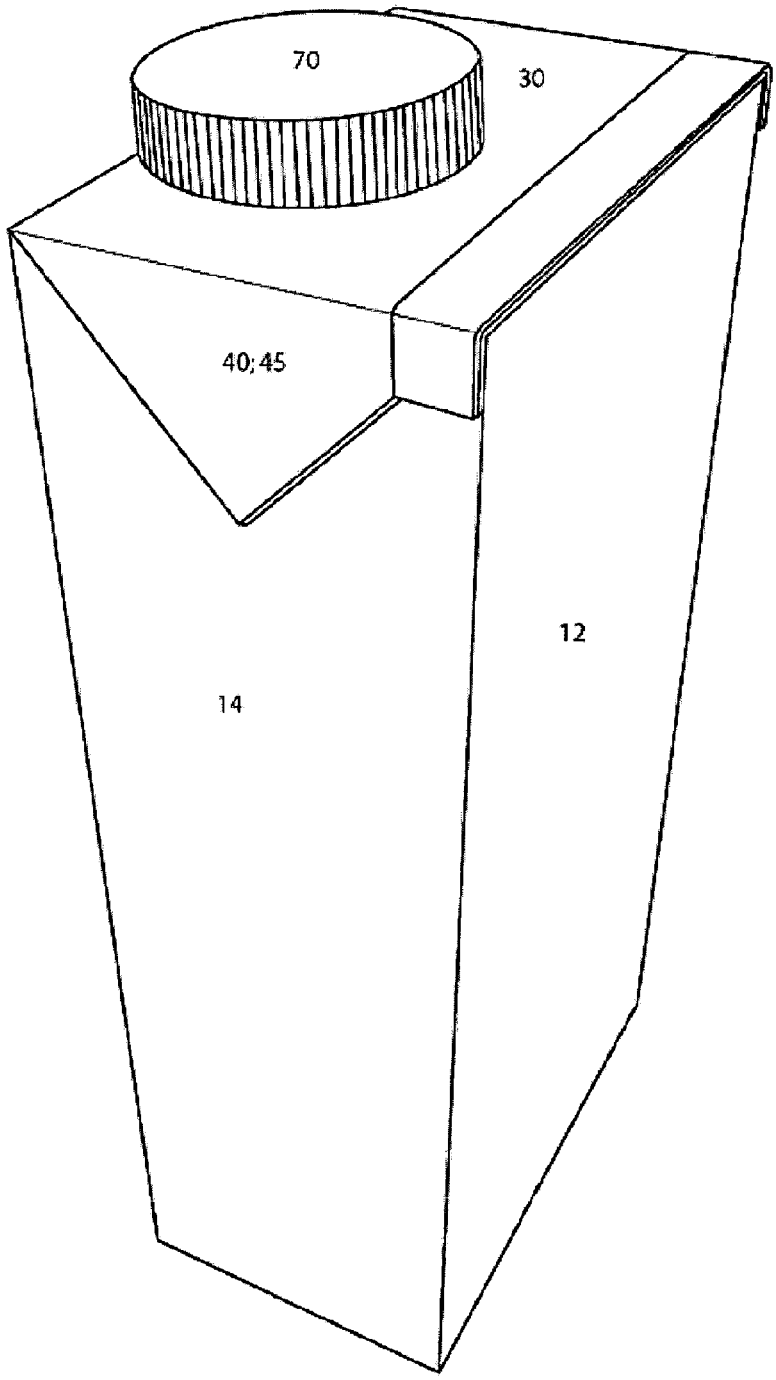
FIG. 5 shows the final package provided with an opening device.

The second top panel 50 has an extension in the longitudinal direction L being equal to the extension in the longitudinal direction L of the sealing area 52 of the second top panel 50. With this design the sealing fin formed by the abutting sealing areas 32, 52 will, when folded backwardly to abut the second top panel 50, have its upper edge essentially in flush with the back panel 12 (see FIG. 5). It is preferred that the upper edge of the sealing fin is slightly within perimeter of the top surface in order to avoid that the sealing fin by mistake get caught e.g. by a neighbouring package.

In summary it may be said that the package respective blank comprises a front panel 10, a back panel 12 and two side panels 14, 16 forming a tubular container body extending in a longitudinal direction L from a bottom to a top, a first top panel 30 formed by an extension of the front panel 10 in the longitudinal direction L and being folded to essentially form the top of the package, a first set of two flaps 40, 60 each formed by an extension of respective side panel 14, 16 in the longitudinal direction L, and a second set of two flaps 45, 65 extending in mutual opposing transverse directions T1, T2 which are transverse to the longitudinal direction L, each flap 45, 65 being formed by an extension of the first top panel 30 on a respective side edge of the first top panel 30.

A person skilled in the art readily realises that several modifications and variations are possible within the scope of the invention.

It may for example be noted that although a specific kind of bottom forming method has been disclosed several other methods may be employed. Gable top containers are e.g. typically formed using a slightly different approach where the triangular portions at the extension of the side panels are folded into the container body. The sealing fin will only have an extension along the front and back panels and the sealing areas outside the triangular flaps will be refolded within this shorter sealing fin. It may be noted that there exists still a number of other bottom sealing techniques that may be employed within the scope of the invention.

It may also be noted that the longitudinal cut to provide a flat laid blank may be provided at another location in the transverse direction as long as a sealing flap is provided at the cut, corresponding to sealing flap 18 and sealing area 19, along the complete height in the longitudinal direction of the panels at the cut.

It may also be noted that the flaps may not extend fully as triangles but may be formed as truncated triangles where the top of the triangles are cut off. This truncated configuration is indicated with dashed lines 40*t*, 45*t*, 60*t*, 65*t* in FIG. 1.

The invention claimed is:

1. A blank comprising a front panel, a back panel and two side panels adapted to form a tubular container body and thereby extend in a longitudinal direction from a bottom to a top, the blank further comprising a first top panel formed by an extension of the front panel in the longitudinal direction and being foldable to essentially form a top of a package, a second top panel formed by an extension of the back panel in the longitudinal direction and being adapted to be folded to partly form the top of the package together with the first top panel, a first set of two flaps, each formed by an extension of a respective side panel in the longitudinal direction and being foldable in respect of the respective side panel, and a second set of two flaps extending in mutual opposing transverse directions which are transverse to the longitudinal direction, wherein a) each flap being formed by an extension of the first top panel on a respective side edge of the first top panel and being foldable in respect of the first top panel, or b) a first flap of the second set is formed by an extension of the first top panel on a side of the first top panel and a second flap of the second set is formed by an extension on a side of a complementary first top panel adapted to coincide with the first top panel as the blank is formed into a package, wherein each of the two flaps of the first set is associated with a respective flap of the second set of flaps, wherein a respective inside surface of each flap of the first set is adapted to abut an inside surface of the respective associated flap of the second set and wherein the first and second top panels each comprises a sealing area extending from respective top panel in the longitudinal direction, wherein the second top panel has an extension in the longitudinal direction being equal to the extension in the longitudinal direction of the sealing area of the second top panel, and wherein said sealing areas of the first and second top panels extend along and a distance past respective top panel in the respective transverse directions, wherein each respective flap of the first set of two flaps is separated from the respective associated flap of the second set of two flaps by a cut line.

2. A package comprising a front panel, a back panel and two side panels forming a tubular container body extending in a longitudinal direction from a bottom to a top, wherein the package further comprises a first top panel formed by an extension of the front panel in the longitudinal direction and being folded to essentially form the top of the package, a second top panel formed by an extension of the back panel in the longitudinal direction and being folded to partly form the top of the package together with the first top panel, a first set of two flaps each formed by an extension of a respective side panel in the longitudinal direction and being folded to be planar with the respective side panel, and a second set of two flaps extending in mutual opposing transverse directions which are transverse to the longitudinal direction, each flap being formed by an extension of the first top panel on a respective side edge of the first top panel, wherein each of the two flaps of the first set are associated with a respective flap of the second set of flaps, wherein each flap of said second set of two flaps is folded to be planar with the respective side panel, wherein a respective inside surface of each flap of the first set abuts an inside surface of the respective associated flap of the second set, wherein the first and second top panels each comprise a sealing area extending from the respective top panel in the longitudinal direction, wherein the second top panel has an extension in the longitudinal direction being equal to the extension in the longitudinal direction of the sealing area of the second top panel, wherein said sealing areas of the first and second top panels extend along and a distance past the respective top panel in the respective transverse directions, and wherein each respective flap of the first set of two flaps is separated from the respective associated flap of the second set of two flaps by a cut line.

* * * * *

UNITED STATES PATENT AND TRADEMARK OFFICE

CERTIFICATE OF CORRECTION

PATENT NO. : 8,292,108 B2
APPLICATION NO. : 12/096141
DATED : October 23, 2012
INVENTOR(S) : Rosentreter It is certified that error appears in the above-identified patent and that said Letters Patent is hereby corrected as shown below:

On the Title Page:

Under item (12) and (75) Inventor, delete "Antje Rosentreler" and replace with

--"Antje Rosentreter"--

Signed and Sealed this
Fifth Day of March, 2013

Teresa Stanek Rea
*Acting Director of the United States Patent and Trademark Office*